United States Patent [19]

Bertus et al.

[11] 4,377,494

[45] Mar. 22, 1983

[54] CRACKING CATALYSTS PASSIVATED BY BARIUM

[75] Inventors: Brent J. Bertus; Dwight L. McKay, both of Bartlesville, Okla.

[73] Assignee: Phillips Petroleum Company, Bartlesville, Okla.

[21] Appl. No.: 112,265

[22] Filed: Jan. 15, 1980

[51] Int. Cl.[3] ..... C10G 11/02; C10G 11/05

[52] U.S. Cl. ..... 252/411 R; 208/52 CT; 208/120

[58] Field of Search ..... 252/411 R; 208/52 CT

[56] References Cited

U.S. PATENT DOCUMENTS

| | | | |
|---|---|---|---|
| 2,981,676 | 4/1961 | Adams et al. | 208/120 |
| 3,030,300 | 4/1962 | Flanders et al. | 208/114 |
| 3,030,314 | 4/1962 | Knowlton et al. | 252/432 |
| 3,265,611 | 8/1966 | Flanders | 208/120 |
| 3,409,541 | 11/1968 | Flanders et al. | 208/120 |
| 3,699,037 | 10/1972 | Annesser et al. | 208/120 |
| 3,835,031 | 9/1974 | Bertolacini et al. | 208/120 |
| 3,954,671 | 5/1976 | White | 208/111 |
| 3,977,963 | 8/1976 | Readal et al. | 208/120 |
| 4,115,249 | 9/1978 | Blanton, Jr. et al. | 208/120 |
| 4,233,139 | 11/1980 | Murrell et al. | 208/122 X |
| 4,244,811 | 1/1981 | Grenoble et al. | 208/122 |
| 4,289,608 | 9/1981 | McArthur | 208/120 |

OTHER PUBLICATIONS

Cimbalo et al., "Deposited Metals Poison FCC Catalyst", Oil Gas Journal 70, May 15, 1972, pp. 112, 114, 118, 120 and 122.

Shankland and Schmitkons, "Determination of Activity and Selectivity of Cracking Catalyst", Proc. API 27 (III), 1947, pp. 57–77.

*Primary Examiner*—Delbert E. Gantz
*Assistant Examiner*—G. E. Schmitkons

[57] ABSTRACT

A cracking catalyst is contacted with barium or a compound thereof to mitigate the adverse effects of catalyst contaminants.

16 Claims, No Drawings

CRACKING CATALYSTS PASSIVATED BY BARIUM

BACKGROUND OF THE INVENTION

This invention relates to hydrocarbon cracking catalyst. In another aspect, this invention relates to a method of at least partially restoring the activity of contaminated cracking catalyst. In still another aspect, the invention relates to decreasing the susceptibility of cracking catalysts to the effect of contamination. Also provided is an improved cracking process utilizing said improved catalyst.

In most conventional catalytic cracking processes in which hydrocarbon feedstocks are cracked to produce light distillates a gradual deterioration in the cracking ability of the catalyst occurs. Some of this deterioration is attributable to the deposition on the catalyst of contaminants contained within the feedstock. The deposition of these contaminants, which include nickel, vanadium and iron, tends to adversely affect the cracking process by decreasing production of gasoline and increasing the yields of hydrogen and coke.

OBJECTS OF THE INVENTION

It is thus an object of the present invention to provide a method for restoring the activity of a cracking catalyst which has been at least partially deactivated by metals contamination.

It is a further object of this invention to at least partially prevent deleterious effects caused by metals such as nickel, vanadium and iron on a cracking catalyst.

It is another object of this invention to provide a cracking catayst composition which is less susceptible to the adverse effects caused by metals contamination.

It is yet another object of this invention to provide a cracking process which is particularly useful in cracking hydrocarbon feedstocks containing contaminating metals.

These and other objects of the present invention will be more fully explained in the following detailed description of the invention and the appended claims.

SUMMARY OF THE INVENTION

According to this invention, there is provided a method of reducing the adverse effects caused by deposits of contaminating metals on the cracking catalyst by contacting the cracking catalyst with barium or a compound thereof.

DETAILED DESCRIPTION OF THE INVENTION

In accordance with the present invention, a cracking catalyst is contacted with a treating agent comprised of at least one of barium and compounds of barium. It is presently believed that most forms of barium are effective. The barium compounds suitable for use in the present invention can be organic or inorganic. Oil- or water-soluble barium compounds are preferred. Suitable inorganic barium compounds include the barium salts of mineral acids and basic barium compounds. Examples of suitable barium salts are barium nitrate, barium sulfate, barium halides such as barium chloride, and barium oxyhalides, such as $Ba(ClO_3)_2$. The halogen-containing inorganic compounds are less preferred because of their corrosive effect on process equipment. Representative basic barium compounds suitable for use are barium hydroxide, barium hydrosulfide and barium carbonate. Suitable organic barium compounds include the barium salts of carboxylic acids and barium-chelating agent complexes. The barium carboxylic acid salts can contain from one to about 40 carbon atoms per molecule and the acid moiety can be aliphatic or can be aromatic in nature. Representative compounds are barium acetate, barium butyrate, barium citrate, barium formate, and barium stearate. Suitable barium complexes include complexes in which barium has been incorporated by chelating agents such as 1,3-diketones, ethylene-diamine tetraacetic acid and nitrilotriacetic acid. Barium pentanedionate is the treating agent presently preferred.

Generally, the amount of treating agent which should be contacted with the cracking catalyst is at least a passivating amount. By passivating amount is meant an amount of treating agent which is sufficient to at least partially mitigate at least one of the deleterious effects to the cracking process of decreased catalyst selectivity to gasoline, increased hydrogen and increased coke caused by a deposition on the cracking catalyst of at least one contaminating metal selected from the group of nickel, vanadium and iron. Generally, the amount of treating agent employed will be an amount sufficient to impart to said cracking catalyst a barium concentration of from about 0.01 to about 8 weight percent, based on the weight of the treated cracking catalyst. Preferably, the amount of treating agent contacted with the cracking catalyst is an amount sufficient to impart to the cracking catalyst a barium concentration of from 0.02 to about 2 weight percent. For most equilibrium catalysts, a desirable ratio of barium to contaminants on the catalyst is from about 2:100 to about 200:100, expressed as the weight ratio of barium to the combined weights of vanadium and four times the weight of nickel on the catalyst, the combined weights of vanadium and four times the weight of nickel being referred to hereinafter as vanadium equivalents. More preferably, this ratio is from about 5:100 to about 100:100, and most preferably from about 10:100 to about 80:100. The narrower ranges of values seem to be more preferable from an economic viewpoint.

A variety of methods can be used to contact the treating agent of barium or barium compounds with the catalyst. It can be added to the catalyst as a finely divided solid and mixed by rolling, shaking, stirring, etc. Or, it can be dissolved in a suitable solvent, aqueous or organic, and the resulting solution sprayed on the catalyst or used to impregnate the cracking catalyst—followed by drying to remove the solvent. It can also be dissolved or suspended in the feedstock to the cracking process. A desirable concentration of barium in the feedstock is from about 0.1 to about 100 parts million, preferably from about 10 to about 200 parts per million, based on the elemental weight of barium in the total weight of the feedstock including the treating agent. The narrower range simplifies maintaining an equilibrium concentration of barium on the catalyst. The preferred method of contact is impregnation because it has been employed with good results.

The time required to effect a contact between the treating agent and cracking catalyst is not particularly important. Generally, such time period can range from 0 to about 30 minutes. Likewise, the temperatures at which the contact is effected can be selected from a wide range of values, depending, for example, on whether the treating agent is contacted with the cracking catalyst as a vapor or as in a solution with a relatively low boiling solvent.

It is inherent in this invention that the treated cracking catalyst will be subjected to elevated temperatures. When utilized in a continuous cracking process, the treated cracking catalyst is subjected to temperatures between 800° F. (427° C.) and 1200° F. (649° C.) in the cracking zone and temperatures between 1000° F. (538° C.) and 1500° F. (816° C.) in the regeneration zone. Free oxygen containing gas is also present in the regeneration zone. The contacting of the treating agent with the cracking catalyst can occur in the cracking zone, in the treating zone, or in a catalyst stream between the two zones.

The term "cracking catalyst" as used herein refers to either new or used cracking catalyst materials that are useful for cracking hydrocarbons in the absence of added hydrogen. The cracking catalyst referred to can be a conventional cracking catalyst. The term "unmodified cracking catalyst" as used herein means any cracking catalyst which has not been modified by contact with barium or barium compounds.

Suitable cracking catalysts can be any of those cracking catalysts employed in the catalytic cracking of hydrocarbons boiling above 400° F. (204° C.) for the production of gasoline, motor fuel blending components and light distillates. These cracking catalysts generally contain silica alumina which is frequently associated with zeolitic materials. These zeolitic materials can be naturally occurring or synthetic. Generally, they will have been at least partially ion exchanged with ammonium or rare earth cations. Zeolite modified silica alumina catalysts are particularly applicable to this invention and are preferred because of their stability, high activity, and desirable selectivity. Examples of cracking catalysts into or onto which barium or barium compounds can be incorporated include hydrocarbon cracking catalysts obtained by admixing an inorganic oxide gel with an aluminosilicate, and aluminosilicate compositions which are strongly acidic as the result of treatment with a fluid medium containing at least one rare earth metal cation and a hydrogen ion, or ion capable of conversion to a hydrogen ion. The catalytic cracking materials can vary in pore volume and surface area. Generally, however, the unused cracking catalyst will have a pore volume in the range of about 0.1 to about 1 ml/gram. The surface area of this unused catalytic cracking material generally will be in the range of 50 to about 500 $m^2$/gram. The unused catalytic cracking material employed will generally be in particulate form having a particle size principally within the range of about 10 to about 200 micrometers.

The unused catalytic cracking material as employed in the present invention contains essentially no nickel, vanadium or iron. Particularly and preferably, the nickel, vanadium, and iron and metals content of the unused catalytic cracking material which constitutes the major portion of the unused cracking catalytic of this invention is defined by the following limits:

TABLE I

| | |
|---|---|
| Nickel | 0 to 0.2 weight percent |
| Vanadium | 0 to 0.6 weight percent |
| Iron | 0 to 0.8 weight percent |
| Copper | 0 to 0.02 weight percent |

The weight percentages in this table relate to the total weight of the unused catalytic cracking material including the metals nickel, vanadium and iron but excluding the added barium or compounds of barium. The contents of these metals on the cracking catalyst can be determined by standard methods well known in the art, for example, atomic absorption spectroscopy or by X-ray fluorescence spectroscopy.

Feedstocks amenable to treatment by the cracking catalyst of this invention are, generally, oils having an initial boiling point above 204° C. This includes gas oils, fuel oils, topped crude, shale oil, and oils from coal and/or tar sands. The feedstocks can contain a significant concentration of at least one metal from the group of vanadium, iron, and nickel. The presence of such metals normally affects adversely the catalyst's selectivity. Since these metals become concentrated in the least volatile fractions of oil suitable for use as feedstock, cracking the heavy oil fractions is probably the most important application for the passivated catalyst of this invention. The quantity of added barium required to passivate vanadium, iron and nickel is related directly to the concentration of contaminating metals in the feedstock. The following table relates the total concentration in the feedstock of effective metals, defined herein as the sum of the elemental weights of vanadium, iron and four times the weight of nickel, to a preferred concentration of barium on the cracking catalyst.

TABLE II

| Total Effective Metals in Feedstock, ppm | Barium Concentration on Catalyst, wt. %[1] |
|---|---|
| 40–100 | 0.05–0.8 |
| 100–200 | 0.1–1 |
| 200—300 | 0.15–1.5 |
| 300–800 | 0.2–2 |

[1]Based on weight of treated catalyst. Quantities are expressed as the element.

The method of this invention can be applied to catalytic cracking operations using cracking catalysts to crack hydrocarbons for the production of blending components for motor fuels. The cracking process can utilize a fixed catalyst bed or a fluidized catalyst. A fluid catalyst is preferred. Fluid catalytic operations are generally carried out at temperatures between about 800° F. (427° C.) and about 1200° F. (649° C.) at pressures within the range of subatmospheric to several hundred atmospheres.

Specific conditions in the cracking zone and the regeneration zone of a fluid catalytic cracker depends on the feedstock used, the condition of the catalyst, and the products sought. In general, conditions in the cracking zone include:

TABLE III

| | |
|---|---|
| Temperature: | 427–649° C. (800–1200° F.) |
| Contact time: | 1–40 seconds |
| Pressure: | 10 kiloPascals to 21 megaPascals (0.1 to 205 atm.) |
| Catalyst: oil ratio: | 3/1 to 30/1, by weight |
| Conditions in the regenerator include: | |
| Temperature: | 538–816° C. (1000–1500° F.) |
| Contact time: | 2–40 minutes |
| Pressure: | 10 kiloPascals to 21 megaPascals (0.1 to 205 atm.) |
| Air rate (at 16° C., 1 atm.): | 100–250 $ft^3$/lb coke, or 6.2–15.6 m3/kg coke. |

The treating agent can be advantageously contacted with the cracking catalyst either before or after the cracking catalyst accumulates deposits of heavy metals from the group of nickel, vanadium and iron. Treatment of new cracking catalysts in the above-described manner decreases the susceptibility of the cracking catalyst to becoming partially deactivated when contaminating metals become deposited thereon. Treatment of used cracking catalysts which have become partially deactivated by deposits of contaminating metals with the above-described treating agent at least partially mitigates the detrimental effects caused by the heavy metals.

EXAMPLE 1

A commercial cracking catalyst that had been used in a commercial fluid catalytic cracker until it had attained equilibrium composition with respect to metals accumulation (catalyst was being removed from the process system at a constant rate) was used to demonstrate passivation with barium. The catalyst, being a synthetic zeolite combined with amorphous silica/alumina (clay), was predominantly silica and alumina. Concentrations of other elements together with pertinent physical properties are shown in Table IV.

TABLE IV

| | |
|---|---|
| Surface area, $m^2 g^{-1}$ | 74.3 |
| Pore volume, ml $g^{-1}$ | 0.29 |
| Composition, wt. % | |
| Nickel | 0.38 |
| Vanadium | 0.60 |
| Iron | 0.90 |
| Cerium | 0.40 |
| Sodium | 0.39 |
| Carbon | 0.06 |

A portion of this used, metals-contaminated catalyst was treated with barium as follows. A solution, prepared by dissolving 0.700 g of barium acetylacetonate in 35 ml of water, was stirred into 35 g of the used catalyst. Solvent was removed by heating, with stirring, on a hot plate at about 260° C. This treatment added 0.82 wt. % barium to the catalyst. The treated catalyst was then prepared for testing by aging it. The catalyst, in a quartz reactor, was fluidized with nitrogen while being heated to 482° C., then it was fluidized with hydrogen while the temperature was raised from 482° to 649° C. Maintaining that temperature, fluidization continued for 5 minutes with nitrogen, then for 15 minutes with air. The catalyst was then cooled to about 482° C., still being fluidized with air. The catalyst was then aged through 10 cycles, each cycle being conducted in the following manner. The catalyst at about 482° C. was fluidized with nitrogen for one minute, then heated to 510° C. during two minutes while fluidized with hydrogen, then maintained at 510° C. for one minute while fluidized with nitrogen, then heated to about 649° C. for 10 minutes while fluidized with air, and then cooled to about 482° C. during 0.5 minutes while fluidized with air. After 10 such cycles it was cooled to room temperature while being fluidized with nitrogen.

The used catalyst and the barium-treated catalyst were evaluated in a fluidized bed reactor using topped West Texas crude oil as feedstock to the cracking step. The cracking reaction was carried out at 510° C. and atmospheric pressure for 0.5 minutes, and the regeneration step was conducted at about 649° C. and atmospheric pressure for about 30 minutes using fluidizing air, the reactor being purged with nitrogen before and after each cracking step.

Properties of the topped West Texas crude used in the cracking steps are summarized in Table V.

TABLE V

| | |
|---|---|
| API gravity at 15.6° C. | 21.4° |
| Distillation (ASTM D 1160-61) | |
| IBP | 291° C. |
| 10% | 428 |
| 20% | 468 |
| 30% | 498 |
| 40% | 528 |
| 50% | 555 |
| Carbon residue, Ramsbottom | 5.5 wt. % |
| Analysis for some elements | |
| Sulfur | 1.2 wt. % |
| Vanadium | 5.29 ppm |
| Iron | 29 ppm |
| Nickel | 5.24 ppm |
| Pour point (by ASTM D 97-66) | 17° C. |
| Kinematic viscosity (by ASTM D 445-65) | |
| at 82.2° C. | 56.5 centistokes |
| at 98.9° C. | 32.1 centistokes |

Results of the tests using the two catalysts are summarized in Table VI.

TABLE VI

| Catalyst | Catalyst: oil weight ratio | Conversion Vol. % of feed | Yields: Coke, wt. % of feed | Yields: SCF $H_2$/bbl feed converted | Yields: Gasoline Vol. % of feed | Material balance wt. % |
|---|---|---|---|---|---|---|
| Used | 7.7 | 74.9 | 17.6 | 895 | 54.6 | 100.7 |
| Used + 0.82% Ba | 7.5 | 76.9 | 15.7 | 682 | 62.1 | 98.6 |

This comparison of the two catalysts shows that, at essentially identical conditions, the addition of 0.82 wt. % barium as barium acetylacetonate increased conversion of the feedstock by 2.6 percent, increased gasoline yield by 14 percent, decreased coke yield by 11 percent, and decreased the yield of hydrogen by 24 percent.

What is claimed is:

1. A process to passivate the metals on a cracking catalyst comprising contacting a zeolite-modified silica-alumina fluid catalytic cracking catalyst having deposited thereon a detrimental amount of at least one detrimental metal selected from the group consisting of nickel, vanadium and iron with a treating agent selected from barium and barium compounds so as to impart to said cracking catalyst a barium concentration of from about 0.01 to about 8 weight percent and mitigate the worsened cracking characteristics of the catalyst caused by the at least one detrimental metal.

2. A process as in claim 1 wherein said cracking catalyst is impregnated with said treating agent.

3. A process as in claim 1 wherein said cracking catalyst is mixed with said treating agent.

4. A process as in claim 1 wherein said cracking catalyst is sprayed with said treating agent.

5. A process as in claim 1 wherein said treating agent is a barium compound selected from the group consisting of organic barium compounds and inorganic barium compounds.

6. A process as in claim 5 wherein said inorganic barium compound is selected from the group consisting of a barium salt of a mineral acid and a basic barium compound.

7. A process as in claim 6 wherein said barium salt is selected from the group consisting of barium sulfate, barium nitrate, barium halide and barium oxyhalide.

8. A process as in claim 6 wherein said basic barium compound is selected from the group consisting of barium oxide, barium hydroxide, barium hydrosulfide and barium carbonate.

9. A process as in claim 5 wherein said organic barium compound is selected from the group consisting of a barium salt of a carboxylic acid and a barium complex.

10. A process as in claim 9 wherein said carboxylic acid is selected from the group consisting of acetic acid, butyric acid, citric acid, formic acid and stearic acid.

11. A process as in claim 9 wherein said barium complex is comprised of a chelating agent selected from the group consisting of a 1,3-diketone, ethylenediamine tetraacetic acid, and nitrilotriacetic acid.

12. A process as in claim 5 wherein said treating agent comprises barium acetylacetonate.

13. A process as in claim 1 wherein the amount of treating agent contacted with said cracking catalyst is an amount sufficient to impart to said cracking catalyst a barium concentration of from about 0.02 to about 2 weight percent.

14. A process as in claim 1 wherein the amount of treating agent contacted with said cracking catalyst is an amount sufficient to impart to said cracking catalyst a weight ratio of barium to the combined weight of vanadium and four times the weight of nickel of from about 2:100 to about 200:100.

15. A process as in claim 14 wherein the amount of treating agent contacted with said cracking catalyst is an amount sufficient to impart to said cracking catalyst a weight ratio of barium to the combined weight of vanadium and four times the weight of nickel of from about 5:100 to about 100:100.

16. A process as in claim 15 wherein the amount of treating agent contacted with said cracking catalyst is an amount sufficient to impart to said cracking catalyst a weight ratio of barium to the combined weight of vanadium and four times the weight of nickel of from about 10:100 to about 80:100.

* * * * *